US005296323A

United States Patent [19]

Kobata et al.

[11] Patent Number: 5,296,323

[45] Date of Patent: Mar. 22, 1994

[54] LAMINATED ORGANIC PHOTOSENSITIVE MATERIAL WITH NO INTERFERENCE FRINGES

[75] Inventors: Tomokazu Kobata; Yousuke Matsui; Hisashi Izumi, all of Kobe, Japan

[73] Assignee: Bando Chemical Industries, Ltd., Kobe, Japan

[21] Appl. No.: 15,163

[22] Filed: Feb. 9, 1993

[30] Foreign Application Priority Data

Feb. 10, 1992 [JP] Japan ..... 4-23603

[51] Int. Cl.[5] ..... G03G 5/047

[52] U.S. Cl. ..... 430/59; 430/58

[58] Field of Search ..... 430/58, 59

[56] References Cited

U.S. PATENT DOCUMENTS 4,618,552 10/1986 Tanaka et al. ..... 430/58 X
5,051,328 9/1991 Andrews et al. ..... 430/58 X
5,096,792 3/1992 Simpson et al. ..... 430/58
5,162,182 11/1992 Maruta ..... 430/58

FOREIGN PATENT DOCUMENTS 178361 10/1983 Japan ..... 430/58
41459 2/1991 Japan ..... 430/59

*Primary Examiner*—Roland Martin
*Attorney, Agent, or Firm*—Wegner, Cantor, Mueller & Player

[57] ABSTRACT

There is disclosed a laminated organic photosensitive material which provides a copy image having substantially no interference fringe-like unevenness in darkness thereon. The laminated organic photosensitive material comprises an electroconductive support, an undercoat, a charge producing layer and a charge transporting layer in sequence wherein each of the undercoat and the charge producing layer has a thickness of d (nm) which fulfills the relation $$(2/5)\lambda < d < (3/5)\lambda$$

wherein λ (nm) is the wavelength of rays of light incident on the laminated organic photosensitive material.

12 Claims, 4 Drawing Sheets

LAMINATED ORGANIC PHOTOSENSITIVE MATERIAL WITH NO INTERFERENCE FRINGES

FIELD OF THE INVENTION

This invention relates to a laminated organic photosensitive material, and more particularly to such a laminated organic photosensitive material which has an undercoat, a charge producing layer and a charge transporting layer formed in sequence on an electroconductive support, and yet provides copy images having substantially no interference fringe-like unevenness in darkness derived from interference between rays of light incident on the laminated photosensitive material and rays of light reflected at interfaces of the laminated photosensitive material.

BACKGROUND OF THE INVENTION

A composite or laminated type organic photosensitive material has been developed and put to practical use in recent years. This type of organic photosensitive material is disclosed in, for example, Japanese Patent Publications Nos. 42380/1980 and 34099/1985. It comprises an electroconductive support, a charge producing layer and a charge transporting layer formed on the support. For instance, such a composite photosensitive material has an electroconductive support of aluminum layer deposited on a polyester film, a charge producing layer formed on the aluminum layer, and a charge transporting layer formed on the charge producing layer.

The charge producing layer is formed by, for example, preparing a dispersion of a charge producing substance together with an organic solvent, a binder resin, and if necessary a plasticizer, applying the dispersion onto the support, and drying to a thin film. The charge transporting layer is formed by, for example, dissolving a charge transporting substance in an organic solvent together with a binder resin, and if required a plasticizer, applying the solution onto the charge producing layer, and drying to a thin film.

It is generally accepted that copy images produced with such a laminated photosensitive material as above mentioned by a discharged area developing electrophotographic process often contain image defects such as dark spots or lines thereon. Thus, it is already known that the provision of an undercoat composed of a resin between the electro-conductive support and the charge producing layer to obviate the problem of such image defects.

Accordingly, it is necessary that the undercoat prevents the injection of electric charges into the photosensitive material from the electroconductive support so that the photosensitive material is stably electrified thereby to eliminate the defects on the copy images. It is also necessary that residual potential is not accumulated on the material so that the photosensitive material provides clear images after a long term use. The use of an alcohol soluble polyamide resin has been proposed to form an undercoat to meet those requisites, as disclosed in Japanese Patent Publication No. 58-45707 and Japanese Patent Application Laid-open No. 60-168157.

As above set forth, there have been proposed a variety of improvements in the laminated photosensitive material, however, not a few important problems remain unsolved. One of such problems is that a copy image produced by such a laminated photosensitive material contains interference fringe-like unevenness in darkness thereon.

Figure 1:
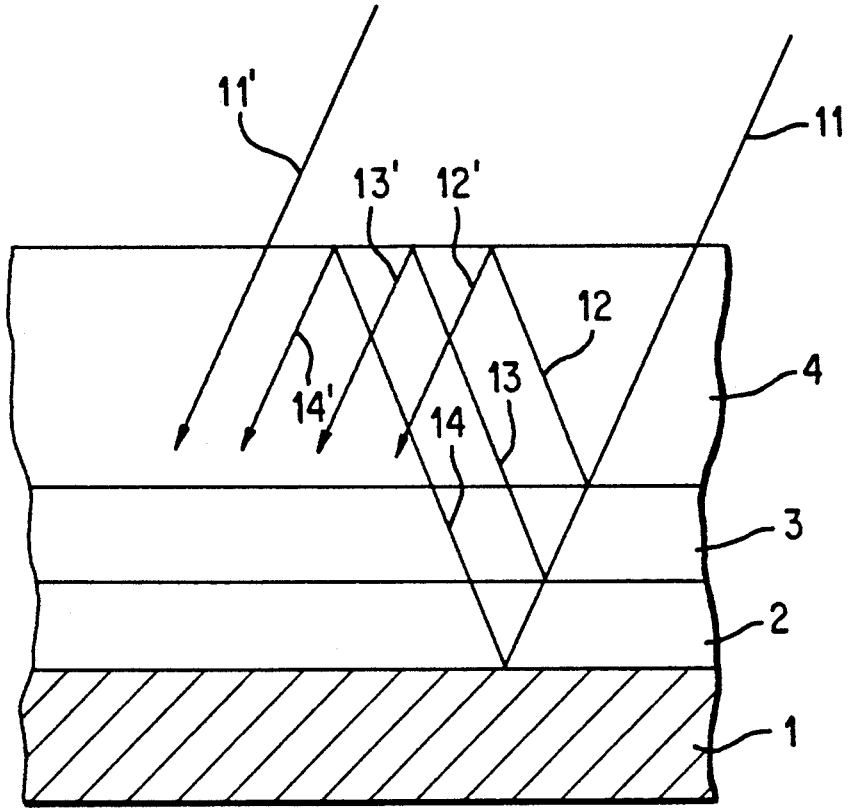
FIG. 1 is a sectional view in part of an example of a laminated organic photosensitive material.

The reason why the electrophotographic process making use of laminated photosensitive material produces a copy image having interference fringe-like unevenness in darkness will be given below with reference to FIG. 1, which is a partial sectional view of a laminated photosensitive material. The laminated photosensitive material has an electroconductive support 1, and an undercoat 2 composed of a resin, a charge producing layer 3 and a charge transporting layer 4 formed in sequence on the support 1. Consider rays of light 11 from a light source and obliquely incident upon a laminated photosensitive material. The rays enter the charge transporting layer 4, and part is reflected at the interface between the charge transporting layer 4 and the charge producing layer 3 (i.e., at the surace of the charge producing layer 3); part further enters the charge producing layer 3 and is reflected at the interface between the charge producing layer 3 and the undercoat 2 (i.e., at the surface of the undercoat 2); and the rest further enters the undercoat 2 and is reflected at the interface between the undercoat 2 and the support 1 (i.e., at the surface of the support 1). The thus reflected rays of light 12, 13 and 14 are again reflected back at the surface of the charge transporting layer 4, and consequently interference occurs between the rays of light 12', 13' and 14' reflected at the surface of the charge transporting layer 4 and rays of light 11' incident upon the laminated photosensitive material. This interference produces unevenness in concentration of photocarriers between the rays of light strengthened and weakened in the photosensitive material, thereby to produce interference fringe-like unevenness in darkness on a solid copy image. This interference fringe-like unevenness in darkness is produced when interfereable laser beams are used as a source of light, but is not produced when a non-interfereable source of light is used.

There have been already proposed a number of measures to prevent undesirable occurrence of interference fringe-like unevenness in darkness on a copy image. For instance, it has been proposed to scatter laser beams incident on a laminated photosensitive material by making the surface of support, undercoat, charge producing layer or charge transporting layer coarse. However, this method tends to produce dark spots on a copy image, as set forth in Japanese Patent Application Laid-open No. 60-172047, No. 60-189747, No. 61-238060 and No. 62-163058. It has also been proposed to form a colored alumite layer on a substrate, as described in Japanese Patent Publication No. 2-59457. However, this method has proved to prevent insufficiently the occurrence of interference fringe-like unevenness in darkness on a copy image, and in addition, the method causes rise of production cost.

SUMMARY OF THE INVENTION

It is an object of the invention to provide a laminated organic photosensitive material which provides copy images having substantially no interference fringe-like unevenness in darkness derived from interference between rays of light incident on the laminated photosensitive material and rays of light reflected at interfaces of the laminated layers.

According to the invention, there is provided a laminated organic photosensitive material which comprises an electroconductive support, an undercoat, a charge producing layer and a charge transporting layer in sequence wherein each of the undercoat and the charge producing layer has a thickness of d (nm) which fulfills the relation $$(2/5)\lambda < d < (3/5)\lambda$$

wherein λ (nm) is the wavelength of rays of light incident on the laminated photosensitive material.

DETAILED DESCRIPTION OF THE INVENTION

The present inventors have found that when each of the undercoat and the charge producing layer is so adapted to have a thickness of λ/2 (nm) wherein λ is the wavelength of rays of light incident on the laminated photosensitive material, then the reflected rays of light 12, 13 and 14 interferes with each other thereby to minimize the intensity of the reflected rays of light. It has also been found that when each of the undercoat and the charge producing layer has a thickness from (2/5) λ to (3/5) λ with the extremities, (2/5) λ and (3/5) λ being excluded, the intensity of the reflected rays of light is sufficiently reduced to substantially prevent the occurrence of interference fringe-like unevenness in darkness on a copy image.

According to the invention, it is necessary that each of the undercoat and the charge producing layer has a thickness of d in the range above specified, but it is not necessary that the undercoat and the charge producing layer have the same thickness each other.

The undercoat is composed preferably of an alcohol soluble polyamide resin. The alcohol soluble polyamide resin used in the invention may be a nylon copolymer as described in Japanese Patent Publication No. 58-45707, and may be exemplified by nylon 6/66, 6/66/610 and 6/66/610/12. These alcohol soluble polyamide resins are commercially available. A further example of alcohol soluble polyamide resin may be a chemically modified homonylon such as N-alkoxymethyl modified nylon, which is also commercially available as CM-8000 from Toray K.K.

The above mentioned alcohol soluble polyamide resins are soluble in lower aliphatic alcohols such as methanol, ethanol, propanol or butanol, or a mixture of these. The alcohol soluble polyamide resin is therefore dissolved in such an alcohol, and the solution is applied onto the surface of the electroconductive support, heated and dried, to form an undercoat having a thickness as above specified.

The alcohol solution of the polyamide resin may contain, if necessary, an aromatic hydrocarbon such as benzene, toluene or xylene to improve the stability of the solution. The alcohol solution may further contain a small amount of a solvent, if necessary, such as water, trichloroethylene, chloroform, benzyl alcohol, phenol, oxalic acid or acetic acid. The undercoat may have a thickness usually of 0.3–5 microns depending upon the wavelength of rays of light used.

The photosensitive material of the invention has a charge producing layer on the undercoat. The charge producing layer contains X-type nonmetal or metal-free phthalocyanine as a charge producing substance. The X-type nonmetal phthalocyanine is represented by the formula:

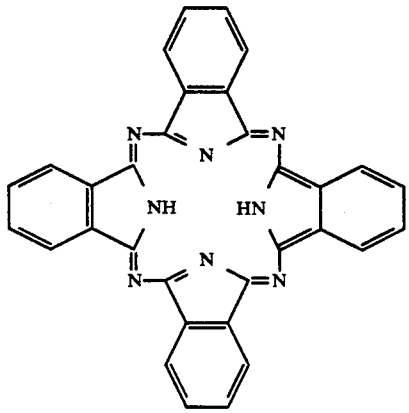

Figure 2:
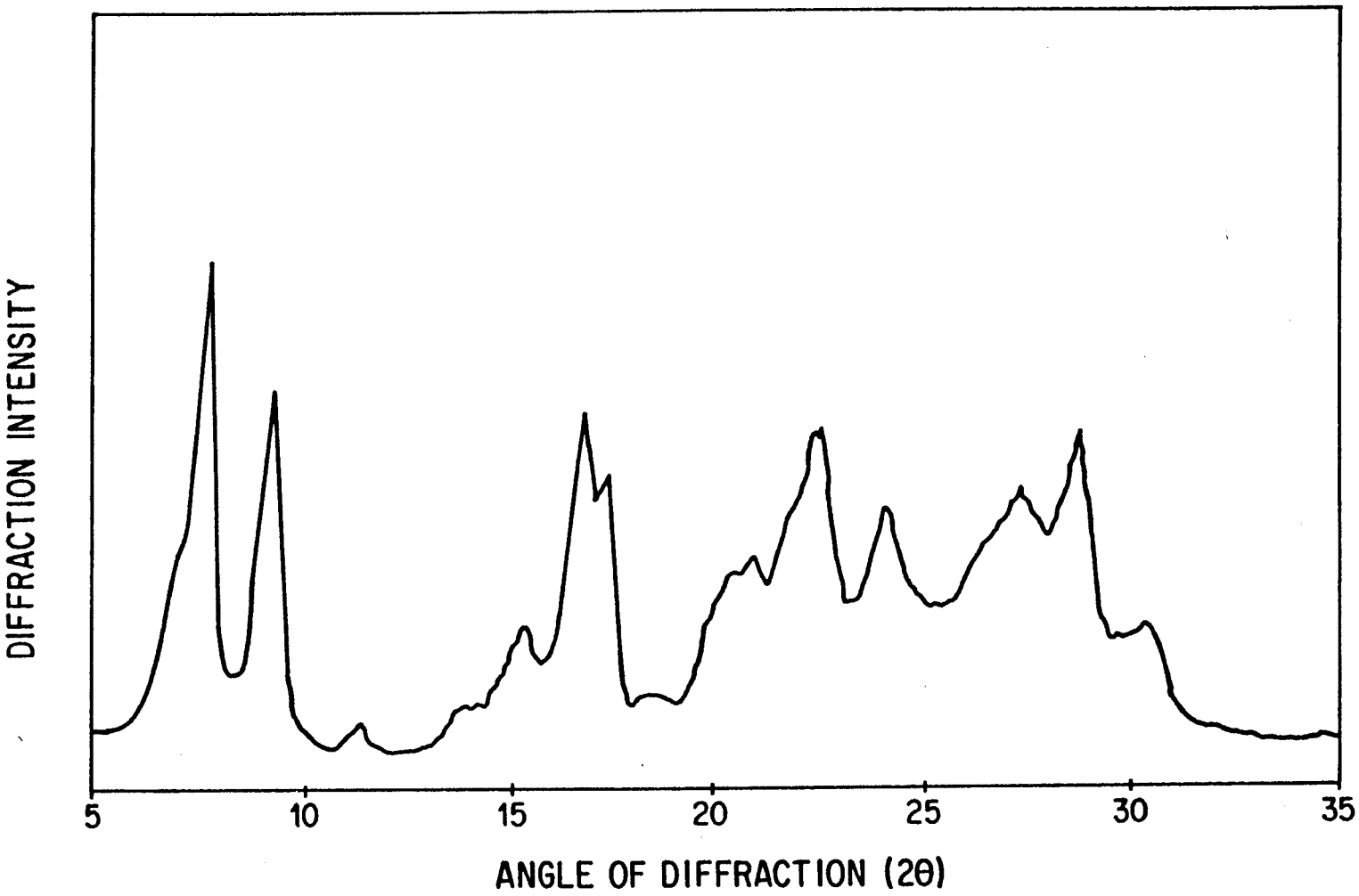
FIG. 2 is an X-ray diffraction diagram (CuK $\alpha$, powder method) of X-type nonmetal phthalocyanine used as a charge producing substance in the laminated organic photosensitive material of the invention.

FIG. 2 is an X-ray diffraction diagram (CuKα, powder method) of the X-type nonmetal phthalocyanine used in the invention.

The charge producing layer is formed with a binder resin such as a vinyl chloride-ethylene copolymer, a vinyl chloride-vinyl acetate-maleic acid copolymer, a polyvinyl butyral resin, or a polyvinyl chloride resin, or a mixture of these. The first two resins or their mixture is particularly preferred.

The smaller the content of the binder resin in the charge producing layer, the better, but it is usually in the range of about 5–50% by weight based on the layer. The charge producing layer has a thickness usually of about 0.05–1 microns depending upon the wavelength of rays of light used.

The organic solvent used in the preparation of the charge producing layer is such that the alcohol soluble polyamide resin is not soluble therein but the binder resin is soluble therein. Thus, the organic solvent used includes, for example, benzene, toluene, xylene, methylene chloride, chloroform, 1,2-dichloroethane, 1,1,2,2-tetrachloroethane, chlorobenzene, dichlorobenzene, ethyl acetate, butyl acetate, methyl ethyl ketone, dioxane, tetrahydrofuran, cyclohexanone, methyl cellosolve or ethyl cellosolve.

The laminated organic photosensitive material of the invention has a charge transporting layer on the charge producing layer. The charge transporting layer contains a charge transporting substance. Any known charge transporting substance may be used, however, a bistyryl compound represented by the formula

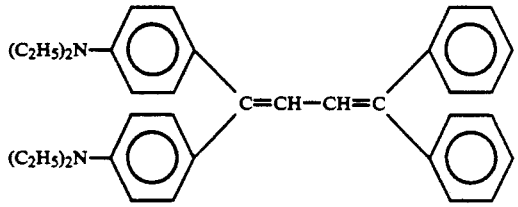

is particularly preferred.

There is used such a binder resin for the charge transporting layer as soluble in an organic solvent and is highly compatible with the charge transporting substance used so that a stable solution thereof may be prepared easily. Moreover, it is prefered to use a resin which is inexpensive and can form a film of high mechanical strength, transparence and electrical insulation. The resin may be either thermoplatic or thermosetting, and may be, for example, polystyrene, styrene-acrylonitrile copolymer, styrene-butadiene copolymer, styrene-maleic anhydride copolymer, polyester resin, polyvinyl chloride, ethylenevinyl chloride copolymer, vinyl chloride-vinyl acetate copolymer, ethylene-vinyl acetate-vinyl chloride copolymer, polyvinyl acetate, polyvinylidene chloride, polyallylate resin, phenoxy resin, polycarbonate, cellulose acetate resin, ethyl cellulose resin, polyvinyl butyral resin, polyvinyl formal resin, polyvinyl toluene, poly(N-vinyl carbazole) resin, acrylic resin, silicone resin, epoxy resin, melamine resin, urethane resin, phenol resin or alkyd resin. Among these resins, a polycarbonate resin is particularly preferred.

The organic solvent used for the preparation of the charge transporting layer is not specifically limited, but it may include, for example, tetrahydrofuran, dioxane, toluene, chlorobenzene, methylene chloride, chloroform, 1,2-dichloroethane or 1,1,2,2-tetrachloroethane.

The content of the charge transporting substance in the charge transporting layer is usually in the range of about 10–60% by weight based on the layer, and the thickness of the layer is usually in the range of about 5–100 microns.

If necessary, the laminated organic photosensitive material of the invention may contain an intermediate layer having a thickness of not more than 0.1 micron either on the undercoat or on the charge producing layer. The intermediate layer may be preferably composed of a cured cyanoacrylate.

The laminated organic photosensitive material of the invention may be manufactured by applying an alcohol solution of the alcohol soluble polyamide resin onto the electro-conductive support and drying to form an undercoat having a thickness as specified hereinbefore, applying a dispersion of a mixture of X-type nonmetal phthalocyanine as a charge producing substance, a binder resin and, if necessary, a plasticizer, in an organic solvent onto the undercoat and drying to form a charge producing layer having a thickness as specified hereinbefore, and then applying a solution of a charge transporting substance, a binder resin and, if necessary a plasticizer, in an organic solvent, to form a charge transporting layer.

The laminated organic photosensitive material of the invention comprises an electroconductive support, an undercoat, a charge producing layer and a charge transporting layer in sequence, and each of the undercoat and the charge producing layer is so adapted as has a thickness d (nm) of more than (2/5) λ but less than (3/5) λ wherein λ is the wavelength of rays of light incident on the laminated photosensitive material. Consequently, the rays of light reflected at each of the interfaces in the laminated photosensitive material so interfere with each other to reduce the intensity of the reflected rays of light, and hence reduce the interference thereof with the rays of light incident on the laminated photosensitive material, thereby to effectively prevent the occurrence of interference fringe-like unevenness in darkness on a copy image.

As a further feature of the invention, the provision of undercoat comprising an alcohol soluble polyamide resin, in conjunction with the use of X-type nonmetal phthalocyanine as the charge producing substance and the use of the before mentioned specified bistyryl compound as the charge transporting substance provides a high performance laminated organic photosensitive material which is readily and stably electrified, has a high photosensitivity, and has no high residual potential after repeated use. Thus, the laminated photosensitive material of the invention provides a copy image carrying no defects thereon such as black spots.

Furthermore, the photosensitive material of the invention has a high sensitivity to a long wavelength region of semiconductor laser and hence suitable for use as a photosensitive material for a laser beam printer.

The invention will now be described more specifically with reference to examples, however, the invention is not limited thereto.

EXAMPLE 1

A solution of 20 parts by weight of alcohol soluble polyamide resin (nylon 6/66/610/12 copolymer, CM-8000 available from Toray K.K.) in a mixture of 250 parts by weight of methanol and 63 parts by weight of butanol was applied onto the outer surface of an aluminum cylinder of 30 mm in outer diameter and dried at 90° C. for 15 minutes to form an undercoat of 0.4 microns in thickness.

A mixture of 2 parts by weight of vinyl chloride-ethylene copolymer having an ethylene content of 8% and an average polymerization degree of 1050 (VE-U available from Tokuyama Sekisui Kogyo K.K.), 0.2 parts by weight of a vinyl chloride-vinyl acetate-maleic acid copolymer composed of 86% by weight of vinyl chloride component, 13% by weight of vinyl acetate component and 1% by weight of maleic acid component, and having an average polymerization degree of about 420 (Esleck M available from Sekisui Kagaku Kogyo K.K.), 3 parts by weight of X-type nonmetal phthalocyanine, 150 parts by weight of methyl ethyl ketone and 50 parts by weight of toluene was milled with a ball mill for two hours to prepare a suspension. The X-ray diffraction diagram (CuKα, powder method) of the X-type nonmetal phthalocyanine used is shown in FIG. 1.

The dispersion was applied onto the undercoat, dried at 90° C. for 15 minutes to form a charge producing layer of 0.4 microns in thickness.

A solution of 130 parts by weight of polycarbonate resin (Panlite C-1400 available from Teijin Kasei K.K.) and 104 parts by weight of the hereinbefore mentioned bistyryl compound in 1004 parts by weight of chloroform was applied onto the charge producing layer and heated at a temperature of 115° C. for 20 minutes to form a charge transporting layer of 20 microns in thickness, whereby a laminated organic photosensitive material was obtained.

EXAMPLE 2

A laminated photosensitive material was prepared in the same manner as in the Example 1 which had an undercoat and a charge producing layer each having a thickness of 0.35 microns.

EXAMPLE 3

A laminated photosensitive material was prepared in the same manner as in the Example 1 which had an undercoat and a charge producing layer each having a thickness of 0.45 microns.

EXAMPLE 4

An intermediate layer composed of cured cyanoacrylate and having a thickness of 0.1 micron was formed on the undercoat, and otherwise in the same manner as in the Example 1, a laminated photosensitive material was prepared.

EXAMPLE 5

An intermediate layer composed of cured cyanoacrylate and having a thickness of 0.1 micron was formed on the charge producing layer, and otherwise in the same manner as in the Example 1, a laminated photosensitive material was prepared.

EXAMPLE 6

An intermediate layer composed of cured cyanoacrylate and having a thickness of 0.1 micron was formed on both the undercoat and the charge producing layer, and otherwise in the same manner as in the Example 1, a laminated photosensitive material was prepared.

COMPARATIVE EXAMPLE 1

A laminated photosensitive material was prepared in the same manner as in the Example 1 which had an undercoat and a charge producing layer each having a thickness of 0.30 microns.

COMPARATIVE EXAMPLE 2

A laminated photosensitive material was prepared in the same manner as in the Example 1 which had an undercoat 0.40 microns thick and a charge producing layer 0.70 microns thick.

COMPARATIVE EXAMPLE 3

A laminated photosensitive material was prepared in the same manner as in the Example 1 which had an undercoat and a charge producing layer each having a thickness of 0.50 microns.

The laminated photosensitive materials prepared as above set forth were each adapted to a discharged area developing laser beam printer (LBP-8II available from Canon K. K., employing rays of light having a wavelength of 780 nm) and copies were made therewith to examine whether interference fringe-like unevenness in darkness appeared on the resultant copy image. When the laminated photo-sensitive materials prepared in the Examples 1–6 were used, no interference fringe-like unevenness in darkness appeared on the copy image. However, when the laminated photo-sensitive materials prepared in the Comparative Examples 1–3 were used, interference fringe-like unevenness in darkness appeared on the copy image.

As a further experiment, the surface of the laminated photosensitive materials prepared as above set forth were each irradiated with a spectrophotometer (MCPD-1000 available from Otsuka Denshi K. K.) to measure the intensity of rays of light reflected thereat and the degree of consequential interference occurred.

Figure 3:
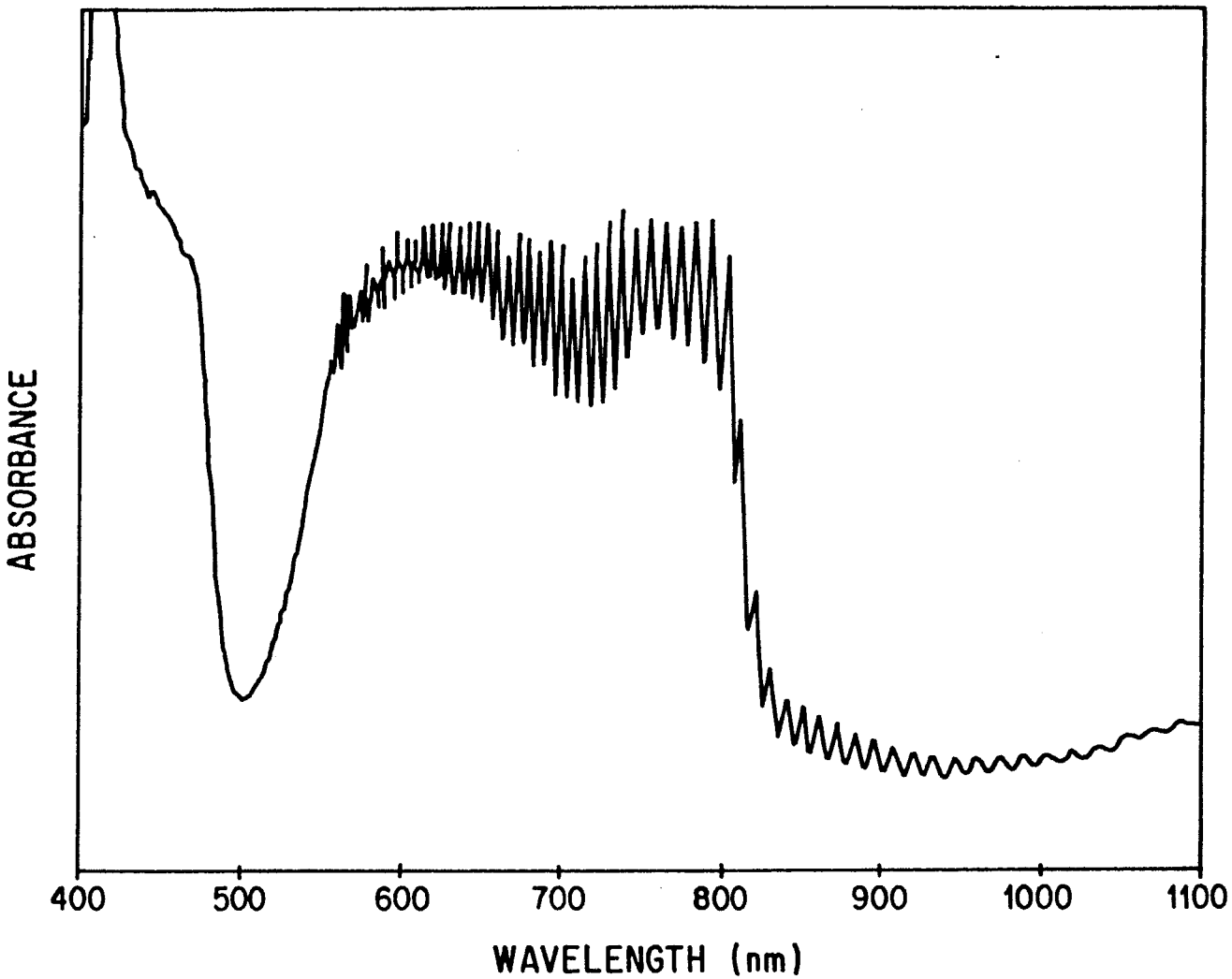
FIG. 3 is a graph showing absorbance of rays of light reflected at the surface of a conventional laminated organic photosensitive material.
Figure 4:
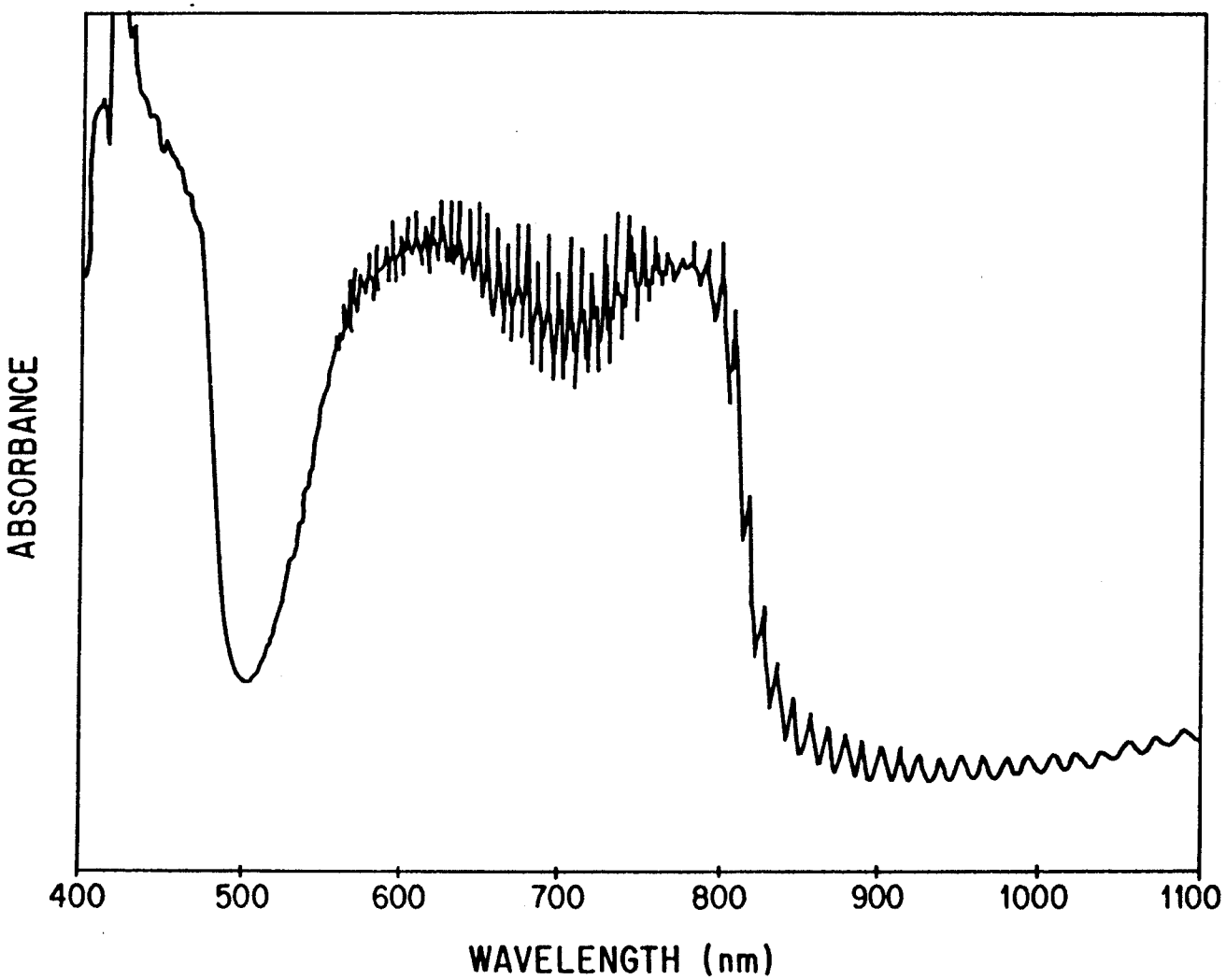
FIG. 4 is a graph showing absorbance of rays of light reflected at the surface of a laminated organic photosensitive material of the invention.

The result with the laminated photosensitive material of the Comparative Example 2 is shown in FIG. 3. It is noted that interference occurred in the wavelength of 760–800 nm. The result with the laminated photosensitive material of the Example 1 is shown in FIG. 4, showing that no interference occurred in the wavelength of 760–800 nm.

What is claimed is:

1. A laminated organic photosensitive material which comprises an electroconductive support, an undercoat, a charge producing layer and a charge transporting layer in sequence wherein each of the undercoat and the charge producing layer has a thickness of d (nm) which fulfills the relation $$(2/5)\lambda < d < (3/5)\lambda$$

wherein λ (nm) is the wavelength of rays of light incident on the laminated organic photosensitive material.

2. The laminated organic photosensitive material as claimed in claim 1 wherein the undercoat is composed of an alcohol soluble polyamide resin.

3. The laminated organic photosensitive material as claimed in claim 1 wherein the charge producing layer contains X-type nonmetal phthalocyanine as a charge producing substance, and the charge transporting layer contains a bistyryl compound represented by the formula

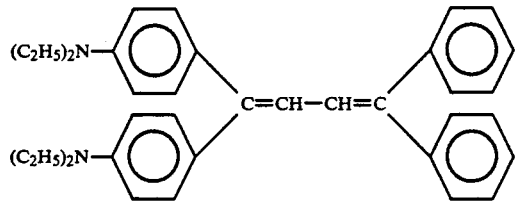

as a charge transporting substance.

4. The laminated organic photosensitive material as claimed in claim 1 wherein the undercoat is composed of an alcohol soluble polyamide resin, and the charge producing layer contains X-type nonmetal phthalocyanine as a charge producing substance, and the charge transporting layer contains a bistyryl compound represented by the formula

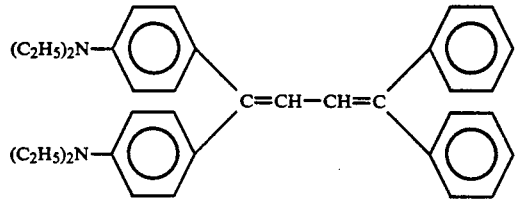

as a charge transporting substance.

5. The laminated organic photosensitive material as claimed in claim 1 wherein an intermediate layer having a thickness of not more than 0.1 micron is formed either on the undercoat or on the charge producing layer.

6. The laminated organic photosensitive material as claimed in claim 1 wherein an intermediate layer having a thickness of not more than 0.1 micron is formed both on the undercoat and on the charge producing layer.

7. The laminated organic photosensitive material as claimed in claim 1 wherein the intermediate layer is composed of a cured cyanoacrylate.

8. The laminated organic photosensitive material as claimed in claim 1 wherein the charge producing layer contains a binder resin selected from the group consisting of a vinyl chloride-ethylene copolymer, a vinyl chloride-vinyl acetate-maleic acid copolymer, and mixture thereof.

9. The laminated organic photosensitive material as claimed in claim 8 wherein the charge producing layer contains the binder resin in an amount of 5-50% by weight based on the layer.

10. The laminated organic photosensitive material as claimed in claim 1 wherein the charge transporting layer contains a polycarbonate resin as a binder resin.

11. The laminated organic photosensitive material as claimed in claim 10 wherein the charge transporting layer contains the binder resin in an amount of 5-60% by weight based on the layer.

12. The laminated organic photosensitive material as claimed in claim 1 wherein the charge transporting layer has a thickness of 5-100 microns.

* * * * *